US012339015B2

(12) United States Patent
Knoll et al.

(10) Patent No.: US 12,339,015 B2
(45) Date of Patent: Jun. 24, 2025

(54) INDOOR UNIT MECHANICAL STRUCTURE FOR IMPROVED FORM FACTOR

(71) Applicant: Quilt Systems, Inc., Redwood City, CA (US)

(72) Inventors: Matthew Aaron Knoll, Redwood City, CA (US); Leon Zilun Zhang, Redwood City, CA (US); Sami Ur-Rehman Shad, Fremont, CA (US); Robert Irving Luan, Berkeley, CA (US)

(73) Assignee: Quilt Systems, Inc., Redwood City, CA (US)

( * ) Notice: Subject to any disclaimer, the term of this patent is extended or adjusted under 35 U.S.C. 154(b) by 0 days.

(21) Appl. No.: 18/662,727

(22) Filed: May 13, 2024

(65) Prior Publication Data

US 2024/0418378 A1 Dec. 19, 2024

Related U.S. Application Data

(60) Provisional application No. 63/508,170, filed on Jun. 14, 2023.

(51) Int. Cl.
*F24F 1/0063* (2019.01)
*F24F 1/0068* (2019.01)
(Continued)

(52) U.S. Cl.
CPC ..... *F24F 1/0063* (2019.02); *F24F 1/0068* (2019.02); *F24F 13/20* (2013.01); *F24F 2013/227* (2013.01)

(58) Field of Classification Search
CPC ..... F24F 1/0063; F24F 1/0068; F24F 13/20; F24F 2013/227
(Continued)

(56) References Cited

U.S. PATENT DOCUMENTS

2003/0217561 A1* 11/2003 Shindo ..... F24F 1/0063 62/262
2007/0079619 A1* 4/2007 Hamada ..... F24F 1/0083 62/186
2020/0158387 A1* 5/2020 Yamashita ..... F28D 1/0452

FOREIGN PATENT DOCUMENTS

EP 763697 A1 * 3/1997 ..... F24F 1/0007
EP 2719970 A2 * 4/2014 ..... F24F 1/0007

OTHER PUBLICATIONS

DIYHomecomfort.com [online], "Heat Pump Noises—The Good and the Bad in 2022 | DIY Home Comfort," Jul. 10, 2022, retrieved on Jun. 6, 2024, retrieved from URL: <https://diyhomecomfort.com/blog/heat-pump-noises>, 20 pages.

* cited by examiner

*Primary Examiner* — Steve S Tanenbaum
(74) *Attorney, Agent, or Firm* — Fish & Richardson P.C.

(57) ABSTRACT

Certain embodiments of an indoor unit (e.g., an indoor unit for a heat pump system) include: a housing comprising an exit-point on a wall-side of the housing, the exit point comprising a refrigerant line and the housing having a height of less than 11 inches; a heat-exchanger connected to the refrigerant line, wherein a portion of the refrigerant line that is external to the heat exchanger, and that runs internal to the housing and between the heat exchanger and an outdoor unit, runs substantially within a height-depth plane of the housing prior to exiting the housing and traverses less than 25% of a width of the housing; and a fan, wherein the indoor unit is configured to exchange at least 8000 BTUs/hour with a room and wherein the indoor unit produces a noise of 48 dBA or less.

19 Claims, 13 Drawing Sheets

(51) Int. Cl.
*F24F 13/20* (2006.01)
*F24F 13/22* (2006.01)

(58) Field of Classification Search
USPC ..... 62/426
See application file for complete search history.

INDOOR UNIT MECHANICAL STRUCTURE FOR IMPROVED FORM FACTOR

CROSS-REFERENCE TO RELATED APPLICATIONS

This application claims the benefit under 35 U.S.C. § 119(e) of the filing date of U.S. Patent Application No. 63/508,170, for Mechanical Structure of Heat Pump for Form Factor Reduction and Operational Features, which was filed on Jun. 14, 2023, and which is incorporated here by reference in its entirety.

BACKGROUND

Technical Field

This specification relates to an indoor unit configuration, e.g., a heat pump indoor unit configuration, that reduces the footprint of the indoor unit without reducing the capacity of the indoor unit.

Background

Heating, ventilation, and air conditioning (HVAC) is one of the largest uses, if not the largest use, of fuel in the home. Homeowners are working towards reducing their carbon footprint and increasing their energy efficiency. Heat pumps electrify the HVAC process and present an energy efficient alternative to traditional HVAC systems. In some circumstances, heat pumps can be used in a centralized system that works similar to central furnace and central air-conditioning systems. Such a system typically requires expensive duct work and takes longer to heat or cool the home because of duct losses. In an alternate system, heat pumps can use ductless systems (sometimes referred to as mini-splits) which may include an indoor unit (e.g., an air-handling unit, evaporator, condenser) that is split off from an outdoor unit (e.g., evaporator, condenser) where the two units are coupled.

SUMMARY

This specification describes technologies for an indoor unit configuration, e.g., a heat pump indoor unit configuration, that reduces the footprint of the indoor unit without reducing the capacity of the indoor unit. As noted above, heating, ventilation, and air conditioning (HVAC) is one of the largest uses, if not the largest use, of fuel in the home. Homeowners are working towards reducing their carbon footprint and increasing their energy efficiency. Heat pumps electrify the HVAC process and present an energy efficient alternative to traditional HVAC systems. In some circumstances, heat pumps can be used in a centralized system that works similar to central furnace and central air-conditioning systems. Such a system typically requires expensive duct work and takes longer to heat or cool the home because of duct losses. In an alternate system, heat pumps can use ductless systems (sometimes referred to as mini-splits) which may include an indoor unit (e.g., an air-handling unit, evaporator, condenser) that is split off from an outdoor unit (e.g., evaporator, condenser) where the two units are coupled.

In such systems, an indoor unit may be placed in each room. The indoor units may be controlled via remote control to allow for individual room heating. However, current indoor unit designs are bulky and cumbersome, which often precludes potential installation points in a room. This shortcoming is further compounded as ductless heat pump systems are often used in affordable housing with reduced floor to ceiling height, which further limits options for installation and often prevents installation above windows and doors. A reduction in size, e.g., height to accommodate these installation points can significantly reduce the capacity of the indoor unit. Hence, the homeowner must sacrifice capacity for flexibility in the installation point or install the indoor unit at a less than desirable location in order to maintain capacity. A typical height for an current indoor unit is 12 inches or more.

Further, heat exchangers used in indoor units may be rigid or curved. Rigid heat exchangers may have reduced performance compared to curved heat exchangers, but they are less expensive to manufacture. Curved heat exchangers may have better airflow performance than rigid heat exchangers but are more expensive to manufacture. Thus, there is a tradeoff between cost and performance in the decision of whether to employ rigid or curved heat exchangers.

In general, one innovative aspect of the subject matter described in this specification can be embodied in an indoor unit (e.g., an indoor unit for a heat pump system) including: a housing comprising an exit-point on a wall-side of the housing, the exit point comprising a refrigerant line and the housing having a height of less than 11 inches; a heat-exchanger connected to the refrigerant line, wherein a portion of the refrigerant line that is external to the heat exchanger, and that runs internal to the housing and between the heat exchanger and an outdoor unit, runs substantially within a height-depth plane of the housing prior to exiting the housing and traverses less than 25% of a width of the housing (in certain embodiments traverses less than 10% or less than 5%); and a fan, wherein the indoor unit is configured to exchange at least 8000 BTUs/hour with a room and wherein the indoor unit produces a noise of 48 dba or less.

The foregoing and other embodiments can each optionally include one or more of the following features, alone or in combination. In particular, one embodiment includes all the following features in combination. The housing can include a wall-side panel, a room-side panel, an upper panel, and a lower panel and wherein the room-side panel is removable. The fan can be a cross flow fan. The indoor unit can include a light bar.

The heat exchanger can include a wall-side region and a room-side region; and one or more spacers between the wall-side region and the room-side region and wherein an angle between the wall-side region and a vertical axis and the room-side region and the vertical axis is greater than or equal to twenty-five degrees and less than or equal to forty-five degrees. The one or more spacers can include one or more holes, openings, or channels. The heat exchanger can include a heat exchanger refrigerant line portion that runs through the one or more holes, openings, or channels.

The housing can have a single exit-point on a wall-side of the housing. The heat exchanger can be an evaporator, condenser, or both an evaporator and condenser. The indoor unit can include a drainage channel having 2 inches or less of head height, wherein head height is the gravity-vertical distance from the bottom of the drain outlet to the lowest point on the lip of the drain basin inside the unit. The indoor unit can include a fan outlet, at least one louver configured to guide air exiting the fan outlet and a finger guard covering at least a substantial portion of the fan outlet and configured to be between the fan and the louver and substantially as far from the fan as possible (e.g., between 10 mm and 50 mm between the closest point on the fan and the closest point on the fingerguard) while not interfering with operation of the at least one louver. A cross section of the finger guard viewed from a side of the indoor unit can be substantially in a shape of an upside-down letter W or substantially in the share of an upside-down letter V. In other words, the fingerguard viewed from a side of the indoor unit when installed can have on or more bends in it.

The height of the heat exchanger can be less than 130 mm. The distance between a top of an upper most refrigerant line of the heat exchanger and the top of the heat exchanger can be less than 3 mm. At least one louver is attached to the housing, and the distance between a bottom most point of the fan and the bottom of the housing when any louvers are closed is less than 80 mm. The distance between the bottom most point of the fan and the bottom of the housing can be less than 45 mm. In certain embodiments the distance between the bottom most point of the fan and the bottom of the housing can be in the range between 30 mm and 80 mm. The housing can have a height of less than 10 inches, less than 9 inches or less than 8 inches. Using millimeters, the housing can have a height of less than 254 mm, 229 mm or less than 203 mm. Furthermore, the housing can have a width of less than 40 inches/1016 mm and depth of less than 10 inches/254 mm. The indoor unit can be configured to exchange energy with a space at the rate of at least 8000 BTUs/hour at the same time that the indoor unit produces a noise of 48 dBA (A-weighted decibel) or less.

Another innovative aspect of the subject matter described in this specification can be embodied in an indoor unit including: an inlet where room air enters the indoor unit: an outlet where the room air exits the indoor unit; a segmented heat-exchanger comprising one or more wall-side regions and one or more room-side regions; a fan that draws the room air into the indoor unit and pushes the room air out of the indoor unit; a housing enclosing the segmented heat-exchanger and the fan and further enclosing a space having a power-unit running at least part of a longitudinal length of the indoor unit; and a louver including a wall-side slat and a room-side slat, the wall-side slat extensive of a wall-side of the outlet and the room-side slat extensive of a room-side of the outlet. The indoor unit can further include one or more spacers between the one or more wall-side regions and the one or more room-side regions. The segmented heat-exchanger can extend around 40% to 80% of a circumference of the fan.

Yet another innovative aspect of the subject matter described in this specification can be embodied in an indoor unit including: a housing comprising an exit-point on a wall-side of the housing, the exit point comprising a refrigerant line and the housing having a height of less than 11 inches, a width of less than 40 inches and a depth of less than 10 inches; a heat-exchanger connected to the refrigerant line, wherein a portion of the refrigerant line that is external to the heat exchanger, and that runs internal to the housing and between the heat exchanger and an outdoor unit, runs substantially within a height-depth plane of the housing prior to exiting the housing and traverses less than 25% of a width of the housing; and a fan wherein the distance between the bottom most point of the fan and the bottom of the housing is less than 45 mm and wherein the indoor unit is configured to exchange at least 8000 BTUs/hour of energy with a room and wherein the indoor unit produces a noise of 48 dba or less.

The subject matter described in this specification can be implemented in particular embodiments so as to realize one or more of the following advantages. Some embodiments described in the present disclosure relate to an indoor unit configuration that reduces the footprint of the indoor unit without reducing the capacity of the indoor unit. Reducing the height of the indoor unit allows for more favorable installation locations above windows and doors. However, reducing the height of the indoor unit may lead to condensation drainage issues, reduced capacity, and reduced space to run condensation and refrigerant lines behind the unit. Some embodiments of the present disclosure address these issues by reconfiguring the internal components of the indoor unit. For example, regions of a heat exchanger proximate a fan may be separated laterally and moved closer to the fan while maintaining their orientation relative to the fan to provide a decrease in height of the indoor unit. As another example, other components, such as a run line set, e.g., a horizontal channel for electrical wiring, refrigerant line(s) running to and/or from the heat exchanger, condensation lines, and/or other tubing may be removed to provide a further reduction of the size of the indoor unit.

Refrigerant lines are designed to give installers the option to exit the back of the device (left or right), on the sides, or out the bottom. In reality, quality contractors almost only use a back exit, an exit directly out of the back of the device (the side of the device that is against a wall). Optionality is driven by the fact that in certain geographies such as in Asia, the market is more a replacement market than a fresh install market, so some manufacturers ensure optionality to replace any existing mini-split in a home. If one is targeting homes which have never had mini-splits, a manufacturer can prescribe the back exit, which is also the most aesthetically pleasing, e.g., it is hidden. Installers often consider side/bottom exits to be a sign of cutting corners.

In some embodiments the height of the indoor unit can be less than 11 inches, less than 10 inches, less than 9 inches, or less than 8 inches. As noted above, reducing the height of the indoor unit allows for the installation of indoor units in more types of dwellings.

In an additional example, the form factor of other components such as a control unit containing the electrical components of the indoor unit may be modified to utilize unused space within the indoor unit, thereby allowing the heat exchanger to be extended to make up for lost capacity that may result from reducing the footprint of the indoor unit. In certain embodiments, the footprint can refer to the height of the indoor unit. In certain other embodiments, the footprint can refer to the area of a cross section of the indoor unit as viewed from the side. To be more specific, if the indoor unit is mounted on a wall that is in a y-z plane in an x-y-z coordinate system then the footprint reflects the cross-section of the indoor unit (not including any louver or light bar) in the x-z plane. In certain embodiments, if the cross-sectional area of the indoor unit varies depending on where in the width of the indoor unit (where along the y axis in the example above) the cross-section is taken, then the footprint can refer to the largest cross sectional area of all the cross-sectional areas.

Reducing the height of the indoor unit may also lead to noise issues and turbulent flow at the air outlet because of a loss in air duct length that may result from the reduced footprint. Some embodiments of the present disclosure address these potential issues by reconfiguring the internal components of the indoor unit. For example, slats of a louver may be reconfigured to recreate the length of an air duct and extend the air outlet.

Some embodiments described in the present disclosure relate to a segmented heat exchanger where a rigid heat exchanger may be segmented to mimic the curvature of a curved heat exchanger to achieve performance similar to that of a curved heat exchanger at the manufacturing cost similar to that of a rigid heat exchanger.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
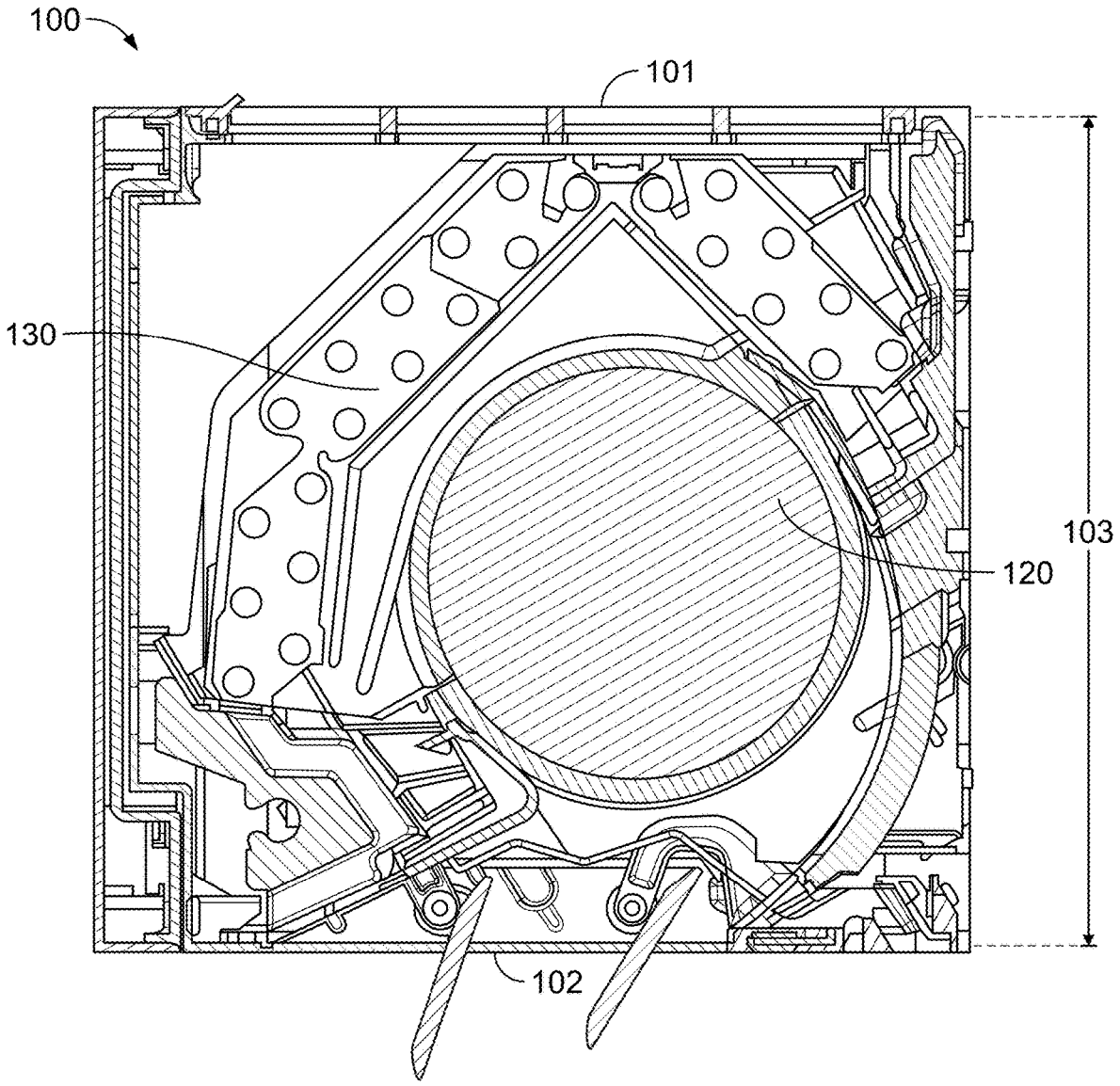
FIG. 1A illustrates a side view of an exemplary indoor unit

This specification describes technologies for an indoor unit configuration, e.g., a heat pump indoor unit configuration, that reduces the footprint of the indoor unit without reducing the capacity of the indoor unit. FIG. 1A illustrates a side view of an indoor unit 100 with a footprint having a height 103. The height can be defined as the highest point on the indoor unit to the lowest point on the indoor unit when the louvers are closed. In operation of the indoor unit 100, room air is pulled into inlet 101 by a fan 120. The room air then passes over a heat exchanger 130, where a heat transfer occurs between the heat exchanger 130 and the room air. The fan 120 then blows the heated or cooled air out of an outlet 102 and back into the room. In certain embodiments, an indoor unit can include a channel within which electrical wiring, refrigerant lines, condensation lines, and/or other tubing may be disposed to run laterally along the wall to which the indoor unit is attached. In other embodiments, that channel is removed to allow for a height reduction of the indoor unit.

Figure 1B:
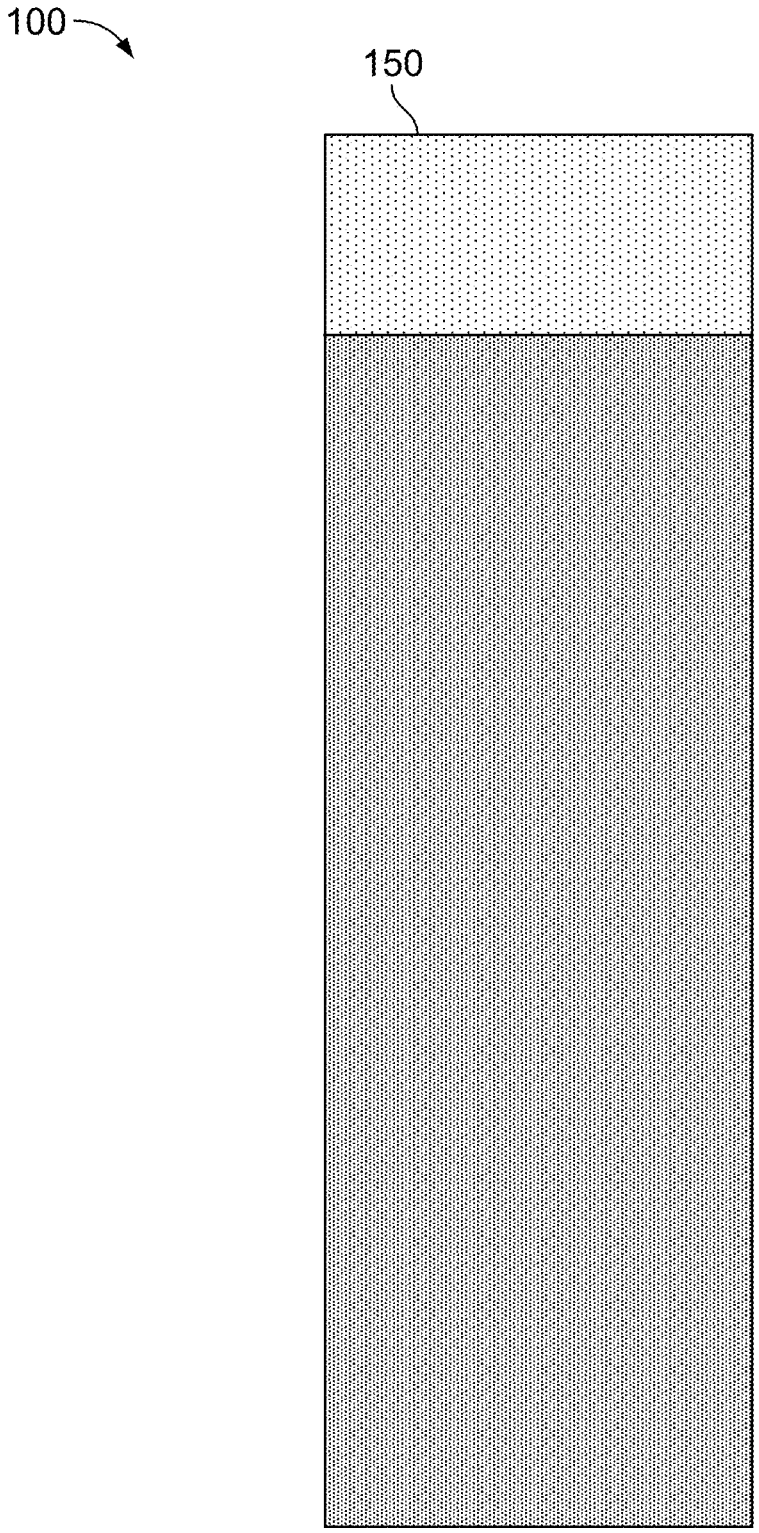
FIG. 1B illustrates a top view of an exemplary indoor unit

FIG. 1B illustrates a top view of one type of indoor unit 100. The indoor unit 100 can include a control unit 150 located at a side location of the indoor unit 100. For example, the control unit 150 may be disposed at one end of the indoor unit 100 and may occupy an entire region such that the heat exchanger 130 and/or the fan 120 (shown in FIG. 1A) cannot project into the lateral region occupied by the control unit 150.

Figure 2:
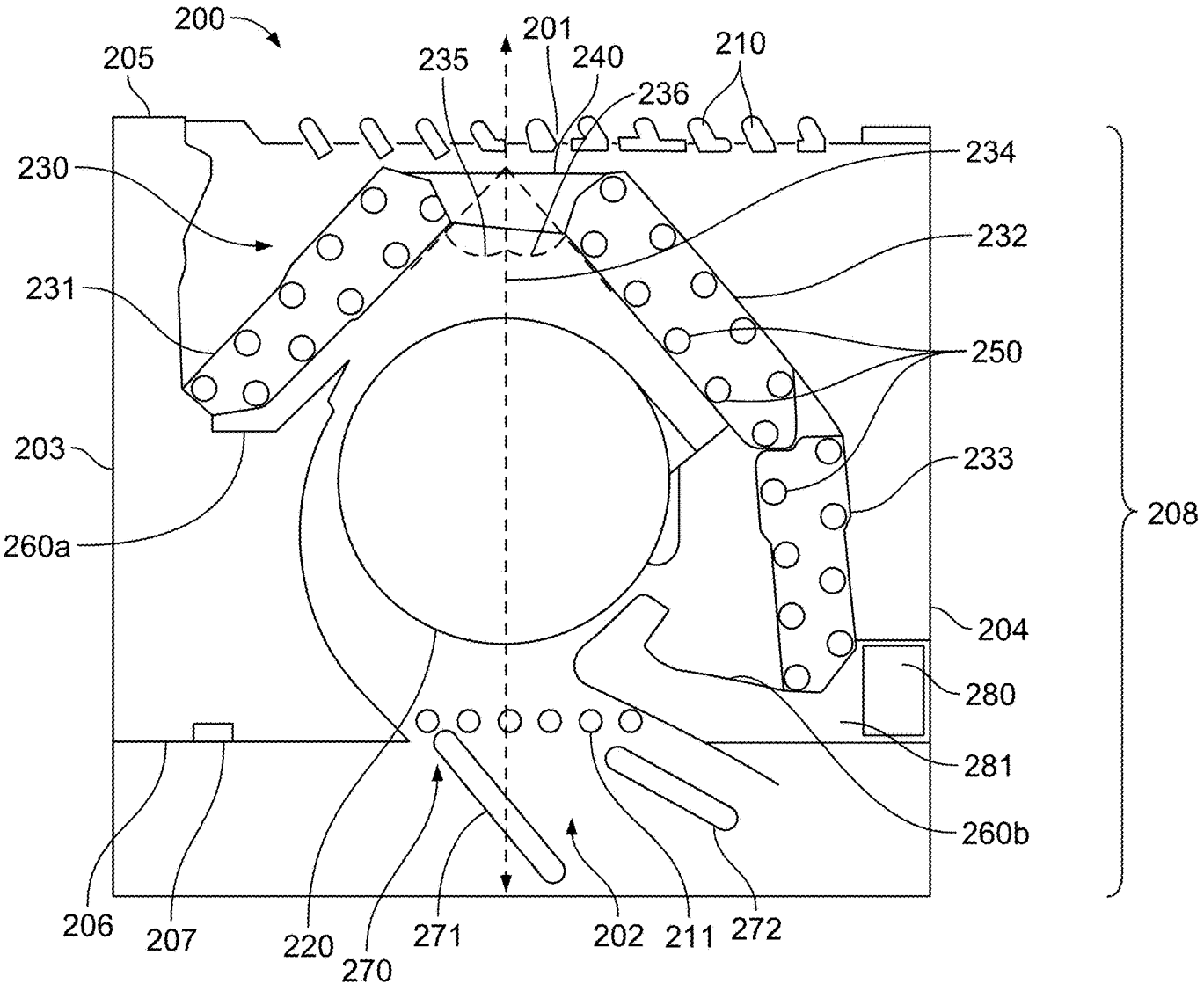
FIG. 2 illustrates a side view of an indoor unit with a reduced footprint according to at least one embodiment in the present disclosure.

FIG. 2. illustrates a side view of an indoor unit 200 with a reduced footprint according to at least one embodiment in the present disclosure. In operation of the indoor unit 200, room air is pulled into an inlet 201 and through a filter 210 by a fan 220. The room air then passes over a heat exchanger 230, where a heat transfer occurs between the heat exchanger 230 and the room air. The fan 220 then blows the heated or cooled air out of an outlet 202 and back into the room. The external structure of the indoor unit 200 may include a wall-side panel 203, a room-side panel 204, an upper panel 205, and a lower panel 206.

As air passes through the filter 210, the filter 210 may remove particulate matter in the room air before the room air passes over the heat exchanger 230. In some embodiments, the filter 210 may be a fiberglass filter, a pleated filter, a washable filter, an electrostatic filter, a UV filter, or any other similar filter. In some embodiments, the filter 210 may be removable. Additionally or alternatively, the filter 210 may be a permanent installation. In some embodiments, multiple filters may be used. Additionally or alternatively, filters may have varying sizes. In some embodiments, the filter 210 may be flat. In some embodiments, the filter 210 may be curved. In embodiments where the filter 210 is curved, the filter 210 may be convex or concave. In some embodiments, the indoor unit 200 may operate or otherwise be implemented without the filter 210.

Figure 4:
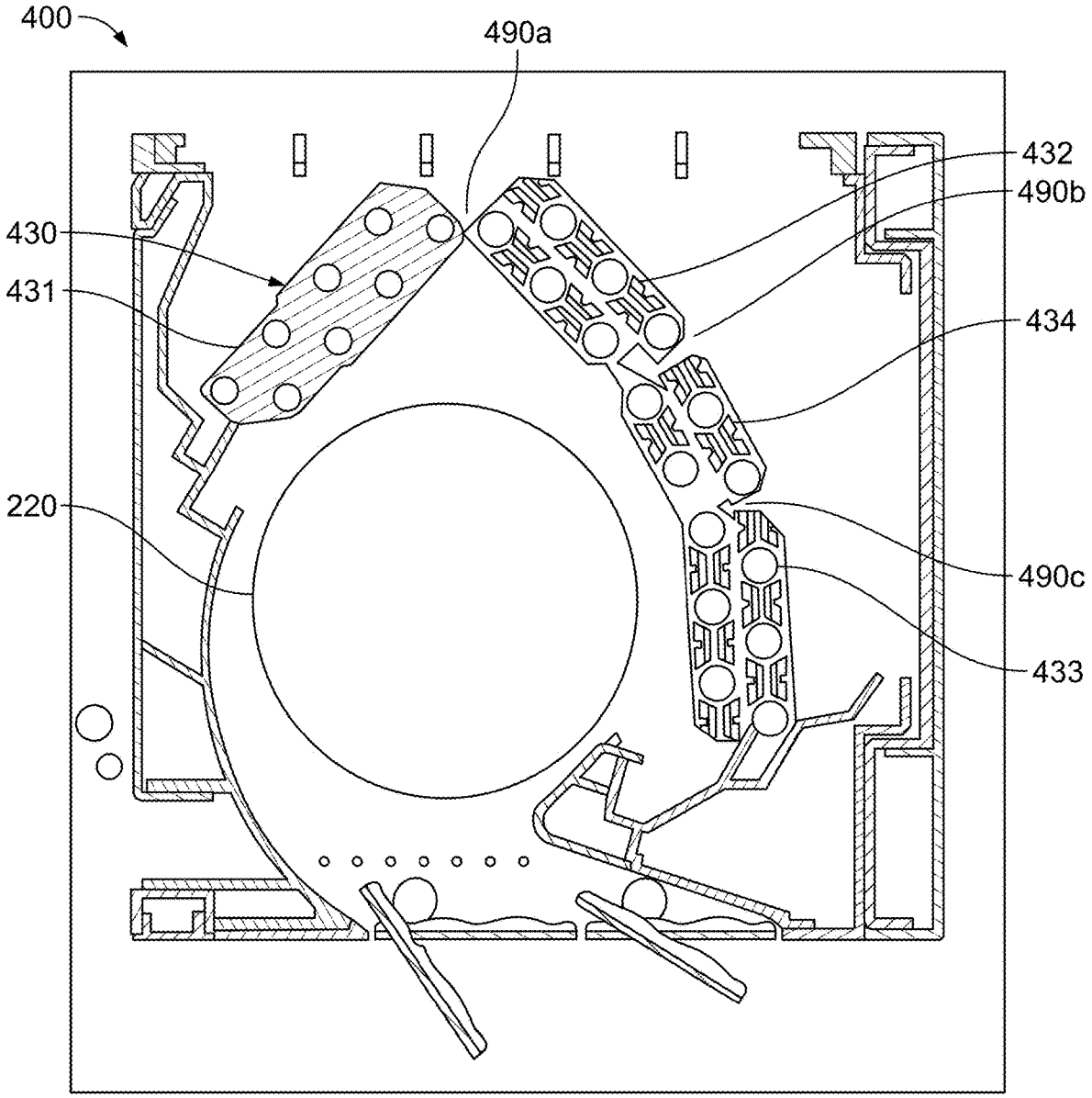
FIG. 4 illustrates a side view of an indoor unit with a reduced footprint according to at least one embodiment in the present disclosure.

In some embodiments, the heat exchanger 230 may have different regions including a wall-side region 231 of the heat exchanger 230 and an upper room-side region 232 and a lower room-side region 233 of the heat exchanger 230. In some embodiments, the heat exchanger 230 may be segmented into further regions on either the wall-side or the room-side of the heat exchanger 230. For example, the room-side of the heat exchanger 230 may include an upper room-side region 232 and a lower room-side region 233. Additionally or alternatively, the heat exchanger 230 may be segmented into additional segments, an example of which is illustrated in FIG. 4. As another example, the wall-side region 231 of the heat exchanger 230 may be segmented into multiple regions (not illustrated). These additional regions may allow the heat exchanger 230 to mimic the curvature of the fan 220 more effectively, which may increase the space on the room-side of the heat exchanger 230. In these and other embodiments, segmentation of the heat exchanger 230 may create a similar shape to a curved heat exchanger, which may improve airflow to the heat exchanger 230 and increase the efficiency and capacity of the indoor unit 200. In some embodiments, the heat exchanger 230 regions may be separate components. In some embodiments, the shape of the heat exchanger 230 may be formed by cutting notches out of the heat exchanger 230 and bending the heat exchanger to the desired form. An example of such a configuration is illustrated with reference to FIG. 4.

In these and other embodiments, an angle 235 between the wall-side region 231 and a vertical axis 234 and an angle 236 between the upper room-side region 232 and the vertical axis 234 may be maintained to a similar or comparable degree to that used in other indoor units which may facilitate proper condensation drainage. For example, the angle 235 between the wall-side region 231 and the vertical axis 234 and the angle 236 between the upper room-side region 232 and the vertical axis 234 may be between about 25° and 45°, between about 30° and 45°, between about 33° and 45°, between about 35° and 40°, and/or approximately 25°, 30°, 35°, 40°, and/or 45°, among others.

In some embodiments, the indoor unit 200 may include a spacer 240 that separates the wall-side region 231 and the upper room-side region 232. In these and other embodiments, the angle 235 and/or the angle 236 may be maintained or modified only slightly (e.g., within) 10° as compared to other heat exchangers through the addition of a spacer 240. The spacer 240 may be configured to spread the heat exchanger 230 outward. This spacing element is up to 10 mm in certain embodiments but could be up to ¼ of the fan diameter in other embodiments. For example, the spacer 240 may include a component that is disposed between the wall-side region 231 and the upper room-side region 232 to space them apart. By including the spacer 240, the depth of the indoor unit 200 may be increased while permitting a reduction of a height 208 of the indoor unit 200. In these and other embodiments, the angle 235 and/or the angle 236 may provide for proper condensation drainage. The reduction in the height 208 facilitated through utilization of the spacer 240 may increase potential installation points of the indoor unit 200. For example, the use of the spacer 240 may allow the indoor unit 200 to be installed above windows and doors where the height without the spacer 240 would preclude installation at those locations. The height of conventional indoor units are typically larger than 11 inches. The height of indoor units according to certain embodiments described in this specification can be less than 11 inches, less than 10 inches, less than 9 inches and less than 8 inches.

In some embodiments, the spacer 240 may be made of foam, plastic, metal, ceramic, or other material suitable for providing spacing between the wall-side region 231 and the upper room-side region 232. In some embodiments, the spacer 240 may be made of a material that is non-reactive with the condensation that forms within the indoor unit 200. In some embodiments, the size of the spacer 240 may be increased to accommodate a larger fan 220. Additionally or alternatively, the size of the spacer 240 may be reduced up to the point where the heat exchanger 230 would interfere with the function of the fan 220 if the angle 235 between the wall-side region 231 and the vertical axis 234 and the angle 236 between the upper room-side region 232 and the vertical axis 234 are maintained. For example, the size of the spacer 240 may be reduced to just before the point where the heat exchanger 230 would contact the spinning fan 220, and/or may include an additional buffer to accommodate tolerances in manufacturing and/or slight variations in the position of the fan 220 during operation.

In some embodiments, the spacer 240 may run the entire length of or approximately the entire length of the indoor unit 200. Additionally or alternatively, the spacer 240 may run the entire length of the fan 220. Additionally or alternatively, the spacer 240 may run approximately 30%, 40%, 50%, 60%, 70%, 80%, or 90% of the length of the fan 220.

In some embodiments, the heat exchanger 230 may be a coil heat exchanger, a finned tube coil heat exchanger, microchannel heat exchanger, or other suitable heat exchangers. In some embodiments, the heat exchanger 230 includes a refrigerant line 250. In these and other embodiments, the refrigerant line substantially running through the heat exchanger 250 may be made of copper or aluminum tubing. Additionally or alternatively, the refrigerant line 250 may be structured as refrigerant loops in the heat exchanger 230. For example, the refrigerant line 250 may include loops that pass back and forth laterally through the wall-side region 231, the upper room-side region 232, and/or the lower room-side region 233. In these and other embodiments, the refrigerant line 250 may include a coil or loop that traverses the spacer 240 from the wall-side region 231 to the upper room-side region 232 or vice versa. In some embodiments, the refrigerant coil or loop may traverse the width of the spacer 240 between the wall-side region 231 to the upper room-side region 232 or vice versa at either end or both ends of the wall-side region 231 and the upper room-side region 232. In some embodiments, the spacer 240 may include a series of spacers dispersed in series down the length of the indoor unit 200. In some embodiments, the spacer 240 may have one or more openings that may provide more direct airflow to the fan 220. In these and other embodiments, the refrigerant line 250 may span between the wall-side region 231 and the upper room-side region 232 between one or more of the series of spacers. Examples of such configurations are illustrated with reference to FIGS. 3A-3D.

According to some embodiments of the present disclosure, the refrigerant line 250 of the heat exchanger 230 may contain and transport refrigerant. In some embodiments, the refrigerant may include R-22, R-32, R-410A, R-407C, R-134a, R-454B or other refrigerants.

In some embodiments, the height 208 of the indoor unit 200 may be reduced by reducing the number of refrigerant loops of the refrigerant line 250 in the heat exchanger 230. The reduction in the number of refrigerant loops may reduce the capacity of the indoor unit 200, but the heat exchanger 230 may be elongated to counteract the potential capacity loss, which may increase the length of the indoor unit 200. In some embodiments, the length increase of the indoor unit 200 may be 5-10% compared to the length of indoor units with a higher number of refrigerant loops. In other embodiments, the length increase may be more or less than 5-10% depending on the necessary capacity of the indoor unit 200. Additionally or alternatively, the length increase of the indoor unit 200 may be approximately 5%, 10%, 15%, 20%, 25%, 30%, 35%, 40%, 45%, 50%, 55%, 60%, 65%, 70%, 75%, 80%, 85%, 90%, 95%, or 100% of the length of indoor units with a higher number of refrigerant loops. The reduced height 208 of the indoor unit 200 may increase the potential indoor unit 200 installation points within the room.

In these and other embodiments, reconfiguring components of the indoor unit 200 may permit a length increase of the heat exchanger 230 while keeping the length of indoor unit 200 the same, which may allow for an increase in the capacity and efficiency of the indoor unit 200. For example, a control unit 280 may be shifted from a side location (illustrated as the location of control unit 150 in FIG. 1B) of the indoor unit 200 to a dead space 281 within the indoor unit 200. In some embodiments, the dead space 281 may be on the room-side of the indoor unit 200. In some embodiments, the dead space 281 may be on the wall-side of the indoor unit 200. In some embodiments, the form factor of the control unit 280 may also be modified to accommodate the shift. For example, the control unit 280 may be elongated and may be reduced in height to fit within the dead space 281. In these and other embodiments, the control unit 280 may include a printed circuit board (PCB) or other circuit board. In embodiments where the control unit 280 includes a PCB, the PCB may be single-sided, double-sided, multi-layer, rigid, flexible, rigid-flex, or other suitable PCBs. Additionally or alternatively, the form factor of the components of the control unit 280 which may include resistors, capacitors, processors, or other components may be reduced to allow the dead space 281 to accommodate the control unit 280. In some embodiments, the control unit 280 may be enclosed by a metal casing to reduce or prevent electromagnetic interference, to reduce or prevent condensation infiltration, or other protective or structural measures. In some embodiments, the dead space 281 may contain insulation, such as metallic insulation, which may function to prevent electromagnetic interference with the control unit 280. An example of such reconfiguration of the indoor unit 200 is illustrated with reference to FIG. 5.

In some embodiments, the heat exchanger 230 may function as an evaporator where the refrigerant is in a liquid state before the fan 220 pulls the room air through the inlet 201 and filter 210 and across the heat exchanger 230. Where the heat exchanger 230 acts as an evaporator, the thermal energy from the room air is transferred to the liquid refrigerant as the fan 220 pulls the room air across the heat exchanger 230. This heat transfer may reduce the temperature of the room air and increase the temperature of the refrigerant causing the refrigerant to evaporate into a gaseous state. The fan 220 may then blow the cooled air out of the outlet 202 and back into the room.

In some embodiments, the heat exchanger 230 may function as a condenser where the refrigerant is in a gaseous state before the fan 220 pulls the room air through the inlet 201 and filter 210 and across the heat exchanger 230. Where the heat exchanger 230 acts as a condenser, the thermal energy from the gaseous refrigerant in the heat exchanger 230 is transferred to the room air as the fan 220 pulls the room air across the heat exchanger 230. This heat transfer may increase the temperature of the room air and may decrease the temperature of the refrigerant causing the refrigerant to condense into a liquid state. The fan 220 may then blow the heated air through the outlet 202 and back into the room.

In some embodiments, the heat exchanger 230 may function as both a condenser and an evaporator depending on the temperature of the room air and the temperature of the refrigerant in the heat exchanger 230. Where the heat exchanger 230 acts as a condenser, the thermal energy from the gaseous refrigerant in the heat exchanger 230 is transferred to the room air as the fan 220 pulls the room air across the heat exchanger 230. This heat transfer may increase the temperature of the room air and may decrease the temperature of the refrigerant causing the refrigerant to condense into a liquid state. The fan 220 may then blow the heated air through the outlet 202 and back into the room. Where the heat exchanger 230 acts as an evaporator, the thermal energy from the room air is transferred to the liquid refrigerant as the fan 220 pulls the room air across the heat exchanger 230. This heat transfer may reduce the temperature of the room air and may increase the temperature of the refrigerant causing the refrigerant to evaporate into a gaseous state. The fan 220 may then blow the cooled air out of the outlet 202 and back into the room.

In some embodiments, insulation (not illustrated) may be included along the internal surface area of any of the wall-side panel 203, the room-side panel 204, the upper panel 205, and/or the lower panel 206 of the indoor unit 200. Additionally or alternatively, the insulation may be included along condensation catches 260*a* and 260*b*. In some embodiments, the insulation may be fiberglass, mineral wool, cellulose, polyurethane foam, thermoplastic foam, aerogels, Styrofoam®, or any other suitable insulation types.

In some embodiments, condensation may form on the refrigerant line 250 and/or on the insulation (not illustrated), which may drip into the condensation catches 260*a* and 260*b* which transfer the condensation into a condensation drain (not illustrated). In some embodiments, the condensation drain may be a condensation line. In some embodiments, a condensation tray (not illustrated) may be used in conjunction with or in replacement of the condensation catches 260*a* and 260*b*. Additionally, or alternatively, the condensation tray may span the space above the fan 220 and below and between the wall-side region 231 of the heat exchanger 230 and the upper room-side region 232 of the heat exchanger 230. In other embodiments, multiple condensation trays could be used. Additionally or alternatively, the condensation tray or trays may be angled similar to the wall-side region 231 and the upper room-side region 232, and the tray or trays may be located under the wall-side region 231 and/or the upper room-side region 232. Additionally or alternatively, the condensation tray or trays may channel condensation into the condensation catches 260*a* and 260*b*. For example, condensation may form on the refrigerant line 250 in the wall-side region 231, which may drip into a condensation tray below the wall-side region 231 that is positioned at a similar angle to the wall-side region 231. The condensation may then be channeled into the condensation catch 260*a* by the condensation tray and into the condensation line (not illustrated) and out of the indoor unit 200. In some embodiments, there may be one or more openings in the condensation tray that may facilitate air flow.

In some embodiments, the fan 220 pulls room air into the indoor unit 200 through the inlet 201 and the filter 210 and across the heat exchanger 230 to heat or cool the air. The fan 220 may blow the heated or cooled air out of the outlet 202 and back into the room. In some embodiments, the fan 220 may be an axial fan, a centrifugal fan, a bi-lobal fan, a tri-lobal fan, a tangential fan, a cross flow fan or another suitable fan. In embodiments where the fan 220 is an axial fan, the fan 220 may be a vane axial fan, a tube axial fan, a propeller fan, or another suitable axial fan. In embodiments where the fan 220 is a centrifugal fan, the fan 220 may be radial, forward-curved, backward-curved, airfoil type, or other suitable centrifugal fans. In embodiments where the fan 220 is a cross flow fan, the fan 220 may be an alternating current (AC) cross flow fan, a direct current (DC) cross flow fan, or an electronically commutated (EC) cross flow fan. In some embodiments, the fan 220 may be powered by an electric motor which receives electricity through a power cord plugged into the wall. Additionally or alternatively, the fan 220 may be solar-powered, battery-powered, or utilize any other source of electricity. In some embodiments where an electric motor is used, the electric motor may be belt-driven or direct driven.

In some embodiments, the wall-side panel 203, the room-side panel 204, the upper panel 205, and/or the lower panel 206 may be removable. For example, the room-side panel 204 may be removable for customization (e.g., swapping out a panel with one color or finish for another with a different color or finish) or mechanical access to the indoor unit 200.

In some embodiments, any of the wall-side panel 203, the room-side panel 204, the upper panel 205, and/or the lower panel 206 may have an attached light bar 207. For example, the lower panel 206 may include the light bar 207 which may be used for accent lighting. In some embodiments, the light bar 207 may be incandescent, or it may be luminescent. In these and other embodiments, the light bar 207 may include one or more LEDs. In some embodiments, the light bar 207 and the fan 220 may have the same power source. Additionally or alternatively, the light bar 207 may have a separate power source than the fan 220. In these and other embodiments, the light bar 207 may be battery-powered, solar-powered, or utilize any other source of electricity.

In some embodiments, the indoor unit 200 may include an exit-point out of the wall-side panel 203 for electrical wiring, the refrigerant line and/or the condensation line supplied by condensation catches 260*a* and 260*b*. For example, the exit-point may correspond to a hole or other opening drilled in the wall for installation purposes of the indoor unit 200. In some embodiments, the exit-point may correspond to the bottom-right side of the wall-side panel 203 when facing the wall. In some embodiments, the exit-point may be limited to one side of the indoor unit 200, which allows for the removal of an exit-point on the other side of the indoor unit 200 and/or removal of a channel to permit the electrical wiring, the refrigerant line, and/or the condensation line to span from one end of the indoor unit 200 to the other for an alternative exit-point. For example, when compared to other indoor units, the channel 140 may be removed by keeping the exit-point on one side. In some embodiments, limiting the exit-point to one side of the indoor unit 200 may permit reduction of the height 208 of the indoor unit 200 because the absence of the channel may allow some components (e.g., the fan 220 and the heat exchanger 230) to be moved downward within the indoor unit 200.

In some embodiments, the heated or cooled air blown out of the indoor unit 200 by the fan 220 and out of the outlet 202 may be regulated, guided, and/or directed by a louver 270 which may include one or more slats such as a wall-side slat 271 and a room-side slat 272. In some embodiments, the louver 270 may be fixed. In some embodiments, the louver 270 may be adjustable. In some embodiments where the louver 270 is adjustable, the louver 270 may be adjusted mechanically (e.g., via a turnwheel or knob) or electrically (e.g., via a button or buttons that communicate to the louver 270 the direction in which it should move). In some embodiments, the louver 270 may be automatically adjusted such that the louver 270 may open when the indoor unit 200 is operating and closed when the indoor unit 200 is not operating. In embodiments where the louver 270 may be adjusted by electricity, the louver 270 and the fan 220 may have the same power source. Additionally or alternatively, the louver 270 may have a separate power source than the fan 220. In these and other embodiments, the louver 270 may be battery powered, solar-powered, or utilize any other source of electricity. In embodiments where the louver 270 is fixed, the slats such as the wall-side slat 271 and the room-side slat 272 may be angled such that the heated or cooled air may flow through the louver 270.

In some embodiments, limiting the exit-point to one side of the indoor unit 200 may permit reduction of the height 208 of the indoor unit 200. The reduction of the height 208 of the indoor unit 200 may result in a shorter outlet 202. A shorter length of the outlet 202 may make the air flow coming from the fan 220 more turbulent, which may cause increased noise and air resistance and reduced flow rate. For example, in larger footprint indoor units, outlets may allow the air to streamline or otherwise coalesce into a consistent flow direction and rate, e.g., as the air exits the unit and/or before it reaches an interfering element like a wire fence 211. Some embodiments of the present disclosure address these issues by reconfiguring the louver 270 to effectively extend the outlet 202 while maintaining the reduced height 208 of the indoor unit 200. For example, the room-side slat 272 may be shifted in the direction of the room so that the room-side slat 272 may be extensive of the room-side of the outlet 202. Additionally or alternatively, the wall-side slat 271 may be extensive of the wall-side of the outlet 202. By having the wall-side slat 271 and the room-side slat 272 extensive with their respective sides of the outlet 202, the outlet may further extend the length of the wall-side slat 271 and the room-side slat 272. This can provide additional length to allow the airflow to streamline or otherwise coalesce into a consistent flow direction and rate. By doing so, noise or other problems can be avoided.

In some embodiments, by having the wall-side slat 271 and the room-side slat 272 extensive with their respective sides of the outlet 202, one side of the slats may be cooled (or heated) while the other remains hot (or cold). This may result in condensation forming on one side of the wall-side slat 271 and/or the room-side slat 272. In these and other embodiments, either face of the wall-side slat 271 and/or the room-side slat 272 may be insulated to reduce or prevent condensation forming on the wall-side slat 271 or the room-side slat 272. Additionally or alternatively, the wall-side slat 271 and/or the room-side slat 272 may be hollow, porous, and/or permeable in order to reduce or prevent condensation forming on the wall-side slat 271 and/or the room-side slat 272. An example of such a reconfiguration is illustrated with reference to FIG. 6.

In some embodiments, heated or cooled air blown out of the indoor unit 200 by the fan 220 and out of the outlet 202 may pass through the wire fence 211. In some embodiments, the wire fence 211 may act as a filtration mechanism, which may prevent particulate matter from entering the indoor unit 200 through the wall-side slat 271 and room-side slat 272. Additionally or alternatively, the wire fence 211 may act as a safety mechanism like a finger guard. For example, the wire fence 211 may prevent extremities from contacting the fan 220. In some embodiments, the wire fence 211 may be similar to the filter 210. In some embodiments, the wire fence 211 may have anywhere between one and one hundred openings per square inch. For example, the wire fence 211 may have one, ten, twenty, thirty, forty, fifty, sixty, seventy, eighty, ninety, and one hundred openings per square inch. While articulated as being a wire fence, it will be appreciated that a plastic grate, or any other similar or comparable component is contemplated within the scope of the present disclosure.

Figure 3B:
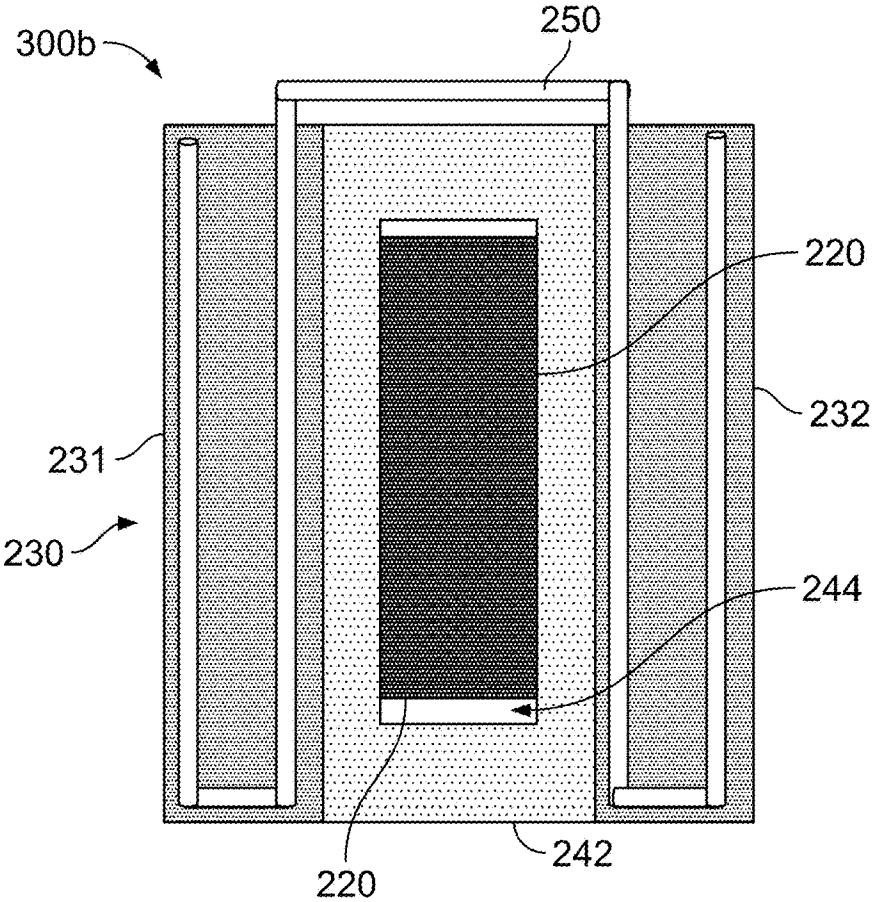
FIG. 3B illustrates a top view of an indoor unit with a reduced footprint according to at least one embodiment in the present disclosure.
Figure 3A:
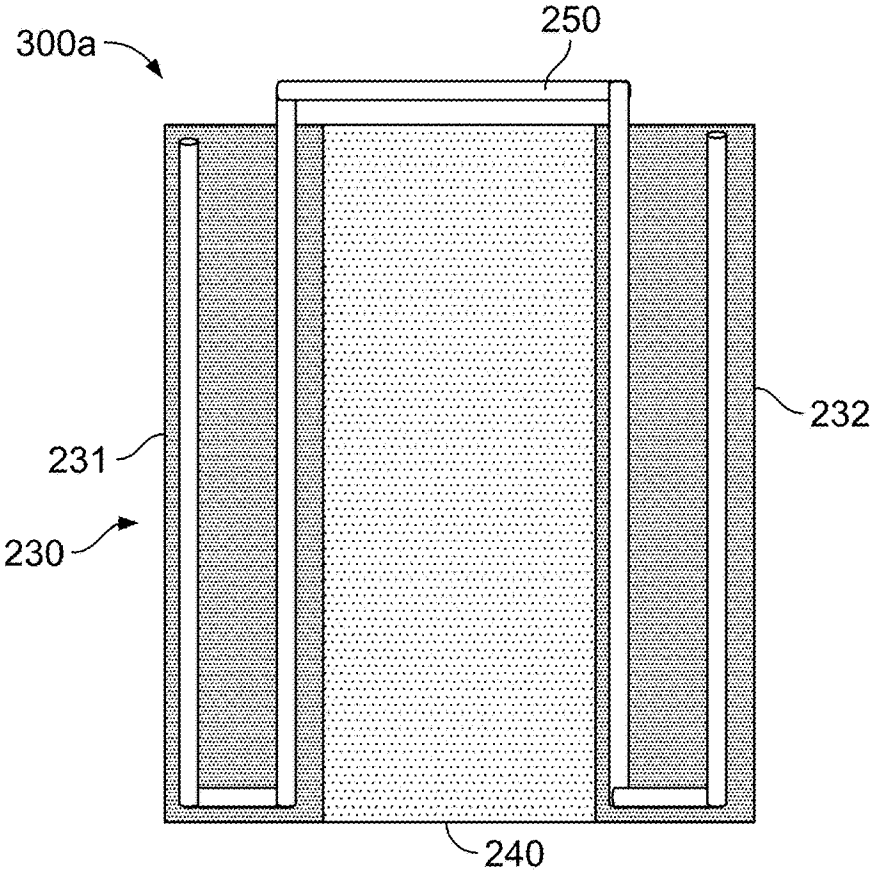
FIG. 3A illustrates a top view of an indoor unit with a reduced footprint according to at least one embodiment in the present disclosure.
Figure 3D:
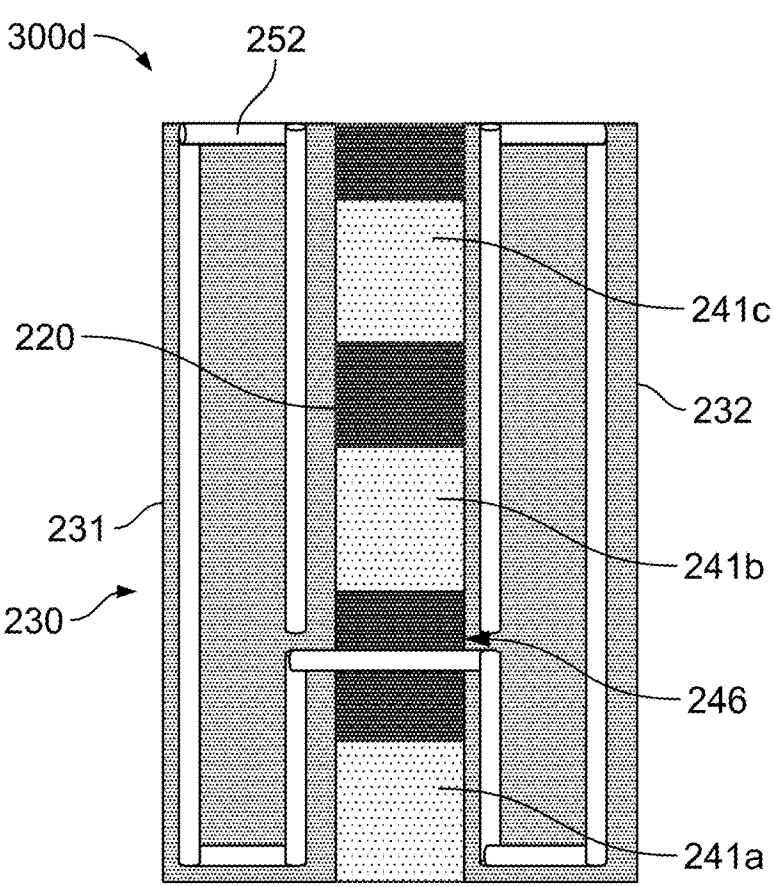
FIG. 3D illustrates a top view of an indoor unit with a reduced footprint according to at least one embodiment in the present disclosure.
Figure 3C:
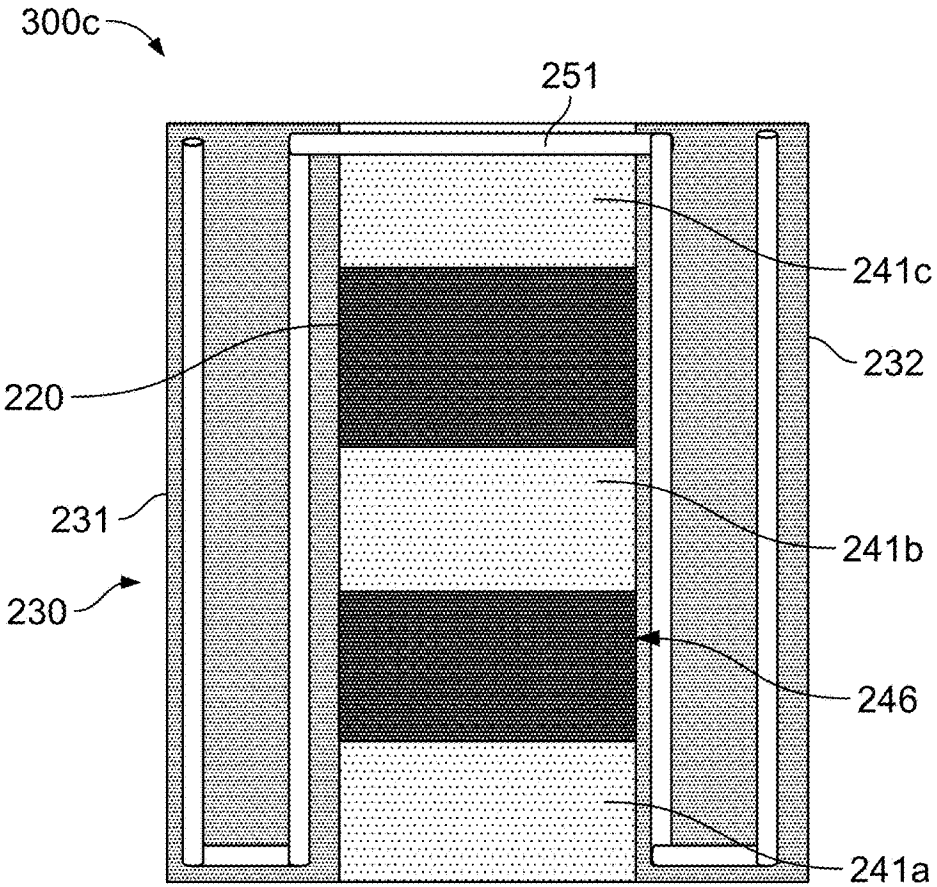
FIG. 3C illustrates a top view of an indoor unit with a reduced footprint according to at least one embodiment in the present disclosure.

FIGS. 3A-3D illustrate various embodiments of implementing the spacer 240, the heat exchanger 230, and the refrigerant line 250 of the indoor unit 200 of FIG. 2. FIG. 3A illustrates a top view of a first embodiment of the spacer 240, the heat exchanger 230, and the refrigerant line 250 of an indoor unit 300*a*. FIG. 3B illustrates a top view of a second embodiment of a spacer 242, the heat exchanger 230, and the refrigerant line 250 of an indoor unit 300*b* in which the spacer is implemented as a single spacer 242 with an opening 244 which may allow mechanical access to the fan 220 and/or may permit more free air-flow within the indoor unit 300*b*. FIG. 3C illustrates a top view of a third embodiment of a spacer, the heat exchanger 230, and the refrigerant line 251 of an indoor unit 300*c* in which the spacer is separated into individual spacers 241*a*, 241*b*, and 241*c* and the refrigerant line 251 traverses between the wall-side region 231 and the upper room-side region 232 of the heat exchanger 230 above the spacer 241*c*. FIG. 3D illustrates a top view of a fourth embodiment of a spacer, the heat exchanger 230, and a refrigerant line 252 of an indoor unit 300*d* in which the spacer is separated into the individual spacers 241*a*, 241*b*, and 241*c* and the refrigerant line 252 extends from the wall-side region 231 to the upper room-side region 232 at an internal gap 246 between the spacers 241*a* and 241*b*.

As illustrated in FIG. 3A, the spacer 240 may traverse the entire length of the fan 220. Additionally or alternatively, the spacer 240 may run approximately 30%, 40%, 50%, 60%, 70%, 80%, or 90% of the length of the fan 220. In some embodiments, the refrigerant line 250 may traverse between the wall-side region 231 and the upper room-side region 232 of the heat exchanger 230 on either side of the spacer 240. Additionally or alternatively, the refrigerant line 250 may traverse between the wall-side region 231 and the upper room-side region 232 of the heat exchanger 230 above or below the spacer 240. Additionally or alternatively, the refrigerant line 250 may traverse between the wall-side region 231 and the upper room-side region 232 of the heat exchanger 230 through the spacer 240 via a hole, channel, or other opening in the spacer 240 shaped and sized to accommodate the refrigerant line 250.

As illustrated in FIG. 3B, the spacer 242 may have an opening 244 which provides mechanical access to the fan 220 and/or permits greater airflow within the indoor unit 300*b*.

As illustrated in FIG. 3C, the spacer may be implemented as a series of spacers between the wall-side region 231 and the upper room-side region 232 of an indoor unit 300*c*. For example, the spacer may include spacers 241*a*, 241*b*, and 241*c* dispersed in series down the length of the indoor unit 300*c*. In some embodiments, the spacers 241*a*, 241*b*, and 241*c* may be evenly distributed along the length of the indoor unit 300*c*. For example, the spacer 241*a* may be placed at one end of the indoor unit 300*c*, the spacer 241*b* may be placed at the midpoint of the indoor unit 300*c*, and the spacer 241*c* may be placed at another end of the indoor unit 300*c*. In some embodiments, the spacers 241*a*, 241*b*, and 241*c* may be distributed unevenly along the length of the indoor unit 300*c*. For example, the spacers 241*a*, 241*b*, and 241*c* may all be placed on one side of the indoor unit 300*c*. In some embodiments, the openings between the spacers 241*a*, 241*b*, and 241*c* may provide mechanical access to the fan 220. In some embodiments, the refrigerant line 251 may traverse between the wall-side region 231 and the upper room-side region 232 of the heat exchanger 230 through any of the spaces between the spacers 241*a*, 241*b*, and 241*c*. Additionally or alternatively, the refrigerant line 251 may traverse between the wall-side region of 231 and the upper room-side region 232 of the heat exchanger 230 through any of the spacers 241*a*, 241*b*, or 241*c* via a hole, channel, or other opening in the spacers 241*a*, 241*b*, or 241*c*. Additionally or alternatively, the refrigerant line 251 may traverse between the wall-side region 231 and the upper room-side region 232 of the heat exchanger 230 above or below any of the spacers 241*a*, 241*b*, or 241*c*. FIG. 3C illustrates an embodiment in which the refrigerant line 251 traverses between the wall-side region 231 and the upper room-side region 232 of the heat exchanger 230 above the spacer 241*c*. FIG. 3D illustrates an embodiment in which the refrigerant line 252 traverses between the wall-side region 231 and the upper room-side region 232 of the heat exchanger at the internal gap 246 between the spacer 241*a* and the spacer 241*b*.

FIG. 4 illustrates a side view of an indoor unit 400 with a reduced footprint according to at least one embodiment in the present disclosure. The indoor unit 400 may be similar or comparable to the indoor unit 200 of FIG. 2. The indoor unit 400 may include a heat exchanger 430 that may be more segmented than the heat exchanger 230 of the indoor unit 200.

As illustrated in FIG. 4, the heat exchanger 430 may be segmented into multiple regions. In some embodiments, these regions may include a wall-side region 431, a upper room-side region 432, a lower room-side region 433, and a middle room-side region 434. In some embodiments, the wall-side region 431 may include one or more upper regions, lower regions, and/or a middle regions (not illustrated). In some embodiments, the room-side region may include one or more upper regions, lower regions, and/or middle regions. In some embodiments, the upper room-side region 432, the lower room-side region 433, and the middle room-side region 434 may be the same length. In other embodiments, the upper room-side region 432, the lower room-side region 433, and the middle room-side region 434 may differ in size. For example, any of the upper room-side region 432, the lower room-side region 433, and the middle room-side region 434 may be larger or smaller than the other regions. In some embodiments, the wall-side region 431, the upper room-side region 432, the lower room-side region 433, and the middle room-side region 434 may be shaped or configured to collectively mimic the curvature of the circumference of the fan 220. In some embodiments, the pseudo- or mimicked curvature of the heat exchanger 430 may be achieved by cutting one or more notches 490 out of the heat exchanger 230 and bending the heat exchanger 230 into the pseudo- or mimicked curved shape at the notches 490. For example, notches 490*a*, 490*b*, and 490*c* may be cut out of the heat exchanger 430 and the heat exchanger may be bent into a shape which may provide a better fit to the form of the fan 220.

In some embodiments, when manufacturing the heat exchanger 430, each of the segments between the notches 490 may be bent or positioned such that a mid-point of the segment is a set distance from the fan 220. The set distance may be selected to correspond to a distance that balances a tradeoff between enough space to avoid turbulent airflow while being close enough to draw the air by the fan 220. In some embodiments, the heat exchanger 430 may be bent or otherwise formed such that no point of any segment is closer than the set distance. In some embodiments, one or more of the segments between the notches 490 may be oriented such that the midpoint of a respective segment is oriented normal to a radial line extending radially outwards from a center of the fan 220. Additionally or alternatively, one or more of the segments may not be oriented normal to a radial line of the fan 220. While a "mid-point" of the segment has been described, it will be appreciated that any other point along a given segment may be selected. In some embodiments, the same point may be used for the normal orientation and for the target distance. Additionally or alternatively, two different points may be selected for the target distance and for the normal orientation.

In some embodiments, the notches 490 may be selected or cut to facilitate or control the shape or degree of bending which occurs for the heat exchanger 430. In these and other embodiments, the notches 490 may extend through most or only part of the material of the heat exchanger 430.

In some embodiments, by utilizing the notches 490, a rectangular piece of material may be used in manufacturing, followed by notching out the piece of material to achieve the pseudo-curved profile. By doing so, the raw material may be used more efficiently and specialized tooling may be avoided. For example, to utilize a curved-profile heat exchanger, specialized tooling may be utilized and the raw materials may be inefficiently used as the curved shapes must be cut out of the raw materials. In comparison, by using the notches 490, the rectangular cut pieces of material may provide a cost savings in manufacturing by avoiding the costs of the specialized tooling and the more efficient use of the raw materials.

Figure 5:
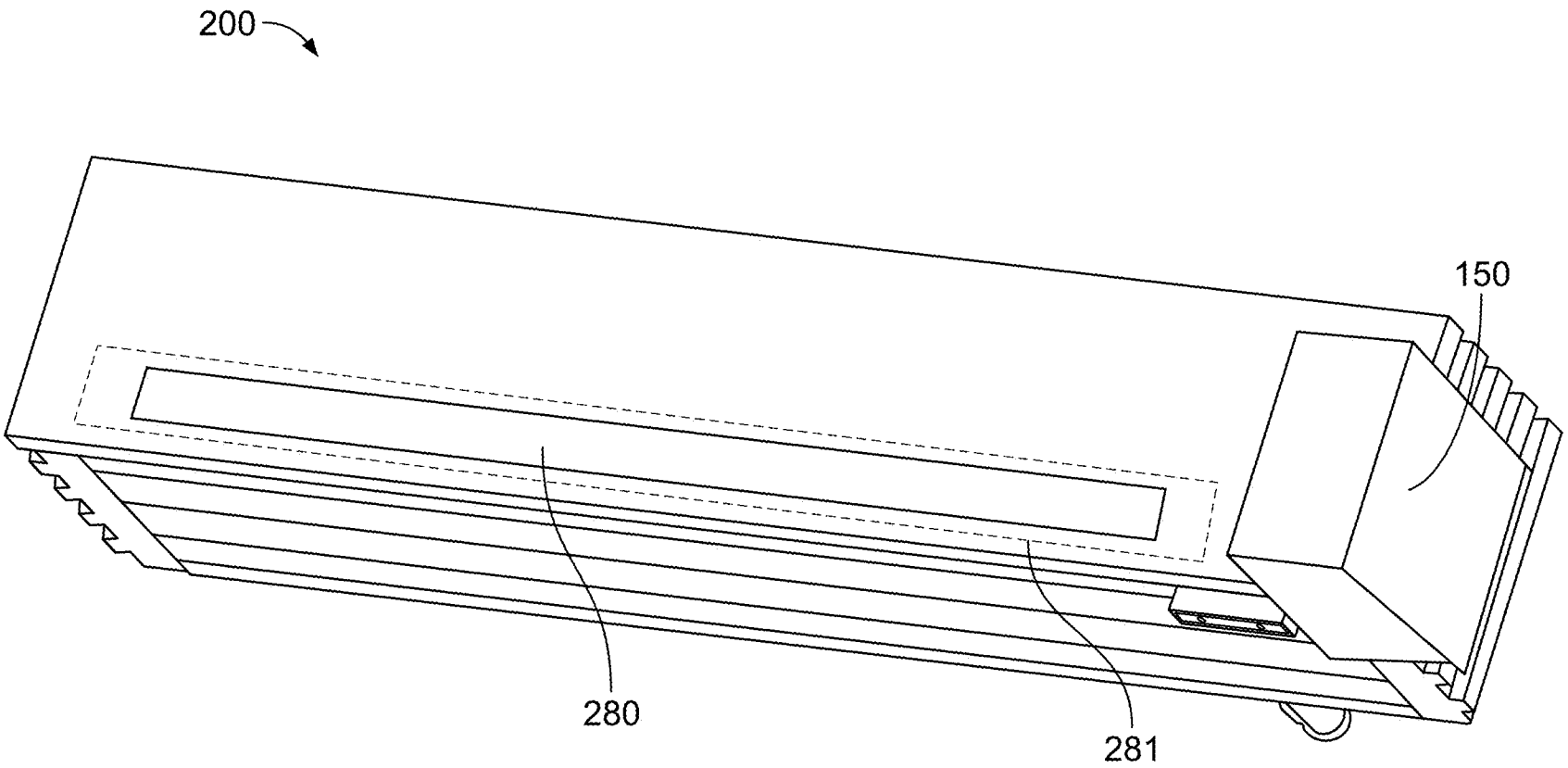
FIG. 5 illustrates a front view of an indoor unit with a reduced footprint according to at least one embodiment in the present disclosure.

FIG. 5 illustrates a front view of an indoor unit 200 with a reduced footprint according to at least one embodiment in the present disclosure. As illustrated in FIG. 5, a control unit 280 may be shifted from a side location of the indoor unit 200 to the dead space 281 within the indoor unit 200. For example, when compared to other indoor units such as the indoor unit 100 of FIG. 1B, the control unit 150 may be reconfigured or shifted to a dead space within the unit. For example, as illustrated in FIG. 5, the previous location of the control unit 150 is overlaid on the indoor unit 200 to illustrate the difference between the side location of the control unit 150 and the dead space 281.

In some embodiments, the form factor of the control unit 280 may be altered to fit within the dead space 281. For example, the indoor unit 100 may allow the control unit 150 to have a larger height, but the dead space 281 may be utilized to house the control unit 280 by changing the shape to a shorter, but longer control unit 280. In some embodiments, the control unit 280 may run the entire length of or approximately the entire length of the indoor unit 200. Additionally or alternatively, the control unit 280 may run the entire length of the fan 220. Additionally or alternatively, the control unit 280 may run approximately 30%, 40%, 50%, 60%, 70%, 80%, or 90% of the length of the fan 220. In some embodiments, the control unit 280 may run the entire depth or approximately the entire depth of the indoor unit 200. Additionally or alternatively, the control unit 280 may run the entire depth of the fan 220. Additionally or alternatively, the control unit 280 may run approximately 30%, 40%, 50%, 60%, 70%, 80%, or 90% of the depth of the indoor unit 200.

Figure 6:
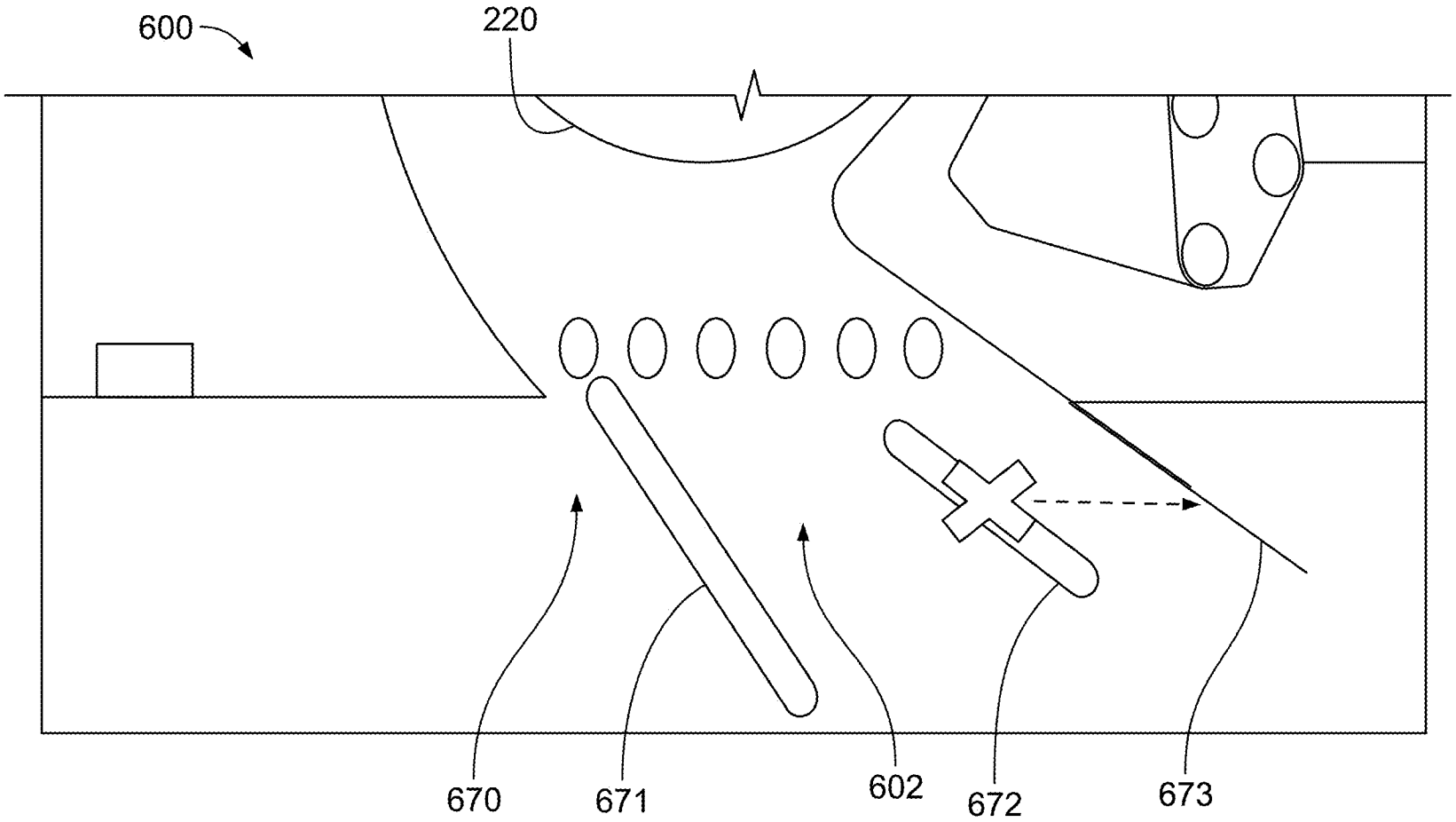
FIG. 6. illustrates a truncated side view of components of an indoor unit with a reduced footprint according to at least one embodiment in the present disclosure.

FIG. 6. illustrates a truncated side view of components of an indoor unit 600 with a reduced footprint according to at least one embodiment in the present disclosure. The indoor unit 600 may be similar or comparable to the indoor unit 200 of FIG. 2. For example, an outlet 602 may be similar or comparable to the outlet 202, a louver 670 may be similar or comparable to the louver 270, a wall-side slat 671 may be similar or comparable to the wall-side slat 271, and a room-side slat 672 may be similar or comparable to the room-side slat 272. The room-side slat 672 may be moved relative to the location of the room-side slat 272 of the indoor unit 200.

As illustrated in FIG. 6, the louver 670 of the indoor unit 600 may be reconfigured to prevent turbulent air flow and/or noise issues with the indoor unit 600. For example, the room-side slat 672 may be shifted to a room-side location 673 so that the room-side slat 672 may be extensive with the room-side of the outlet 602, or in other words, may function as a mechanical extension of the room-side of the outlet 602. Additionally or alternatively, the wall-side slat 671 may be extensive of the wall-side of the outlet 602. In these and other embodiments, either face of the wall-side slat 671 and/or the room-side slat 672 may be insulated to reduce or prevent condensation forming on the wall-side slat 671 or the room-side slat 672. Additionally or alternatively, the wall-side slat 671 and/or the room-side slat 672 may be hollow, porous, and/or permeable in order to reduce or prevent condensation forming on the wall-side slat 671 or the room-side slat 672.

Figure 7A:
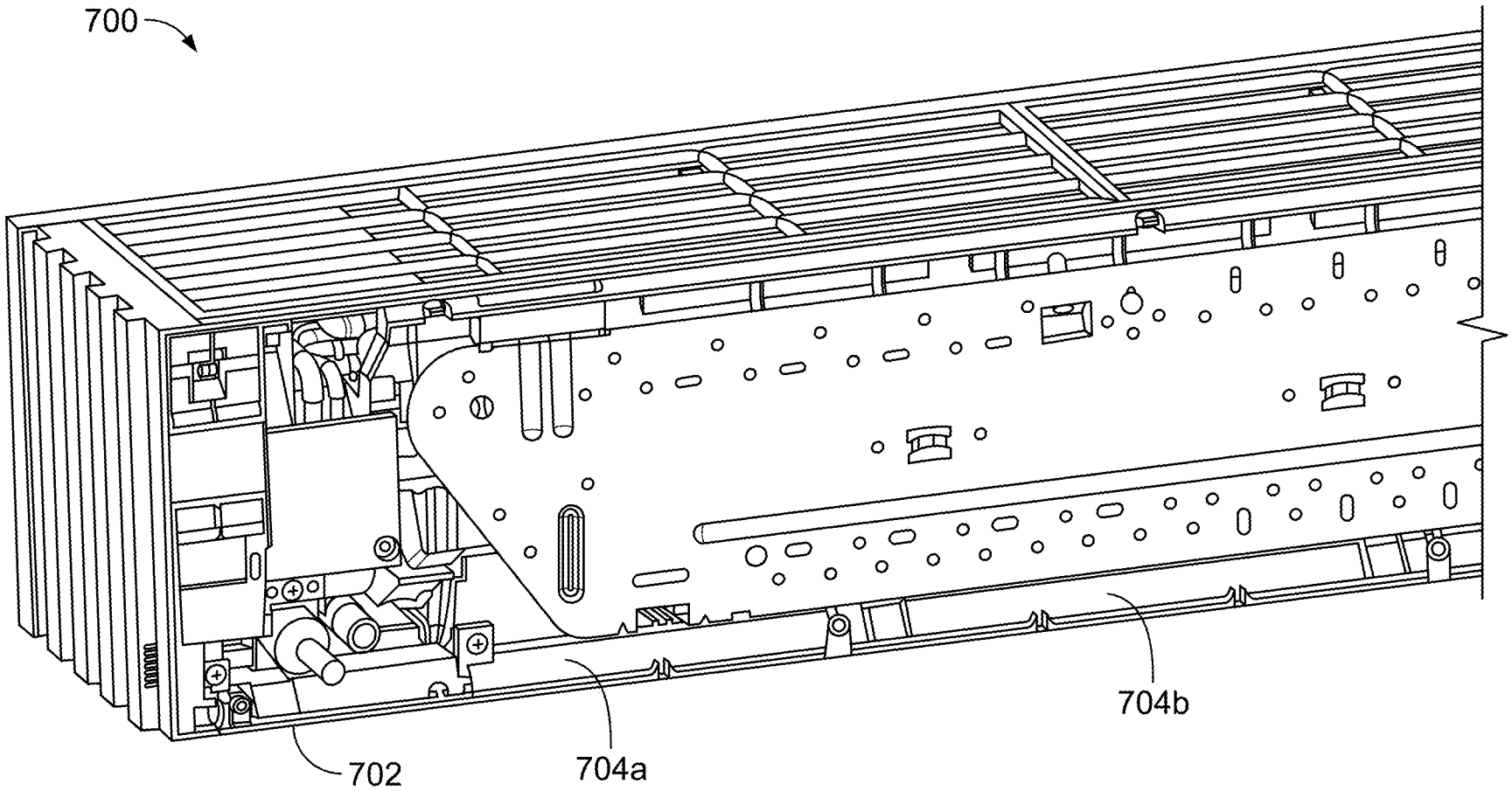
FIG. 7A illustrates a perspective view of an exemplary indoor unit showing the back side of the indoor unit, i.e., the side of the unit that can attach to a wall.

FIG. 7A illustrates a perspective view of an exemplary indoor unit 700 showing the back side of the indoor unit, i.e., the side of the unit that can attach to a wall. Indoor unit 700 is shown with a single exit port on the back right side when a user is facing the indoor unit from the room side of the unit and the unit is mounted on a wall. The single exit port may include a single line or more than one line. For example, the exit port may include an electrical line 702*a* and a refrigerant line 702*b*. By designing the indoor unit to have the lines come directly out a single exit port, lines that previously ran along the length of the indoor unit, e.g., along conduit 704*a* and 704*b*, no longer need to do so, freeing up space in the indoor unit and allowing for a height reduction of the indoor unit. As noted above, such a height reduction has a variety of advantages.

Figure 7B:
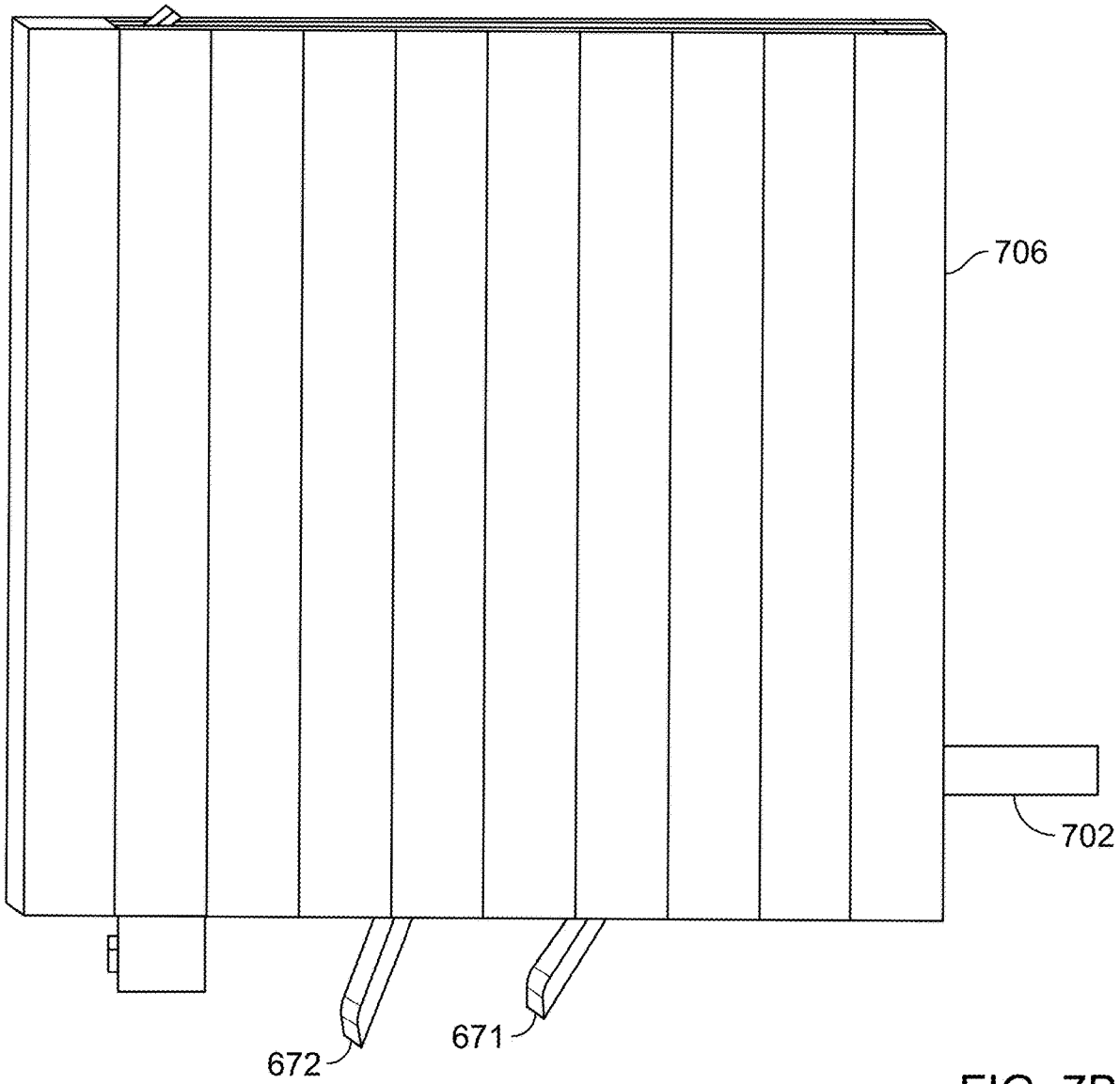
FIG. 7B illustrates a side view of an exemplary indoor unit.

FIG. 7B illustrates a side view of an exemplary indoor unit. As illustrated, electrical and refrigerant lines 702*a* and 702*b* exit the indoor unit via a single exit port in the back wall 706. Louvers 671 and 672 are also shown along with a light bar 708.

Figure 8:
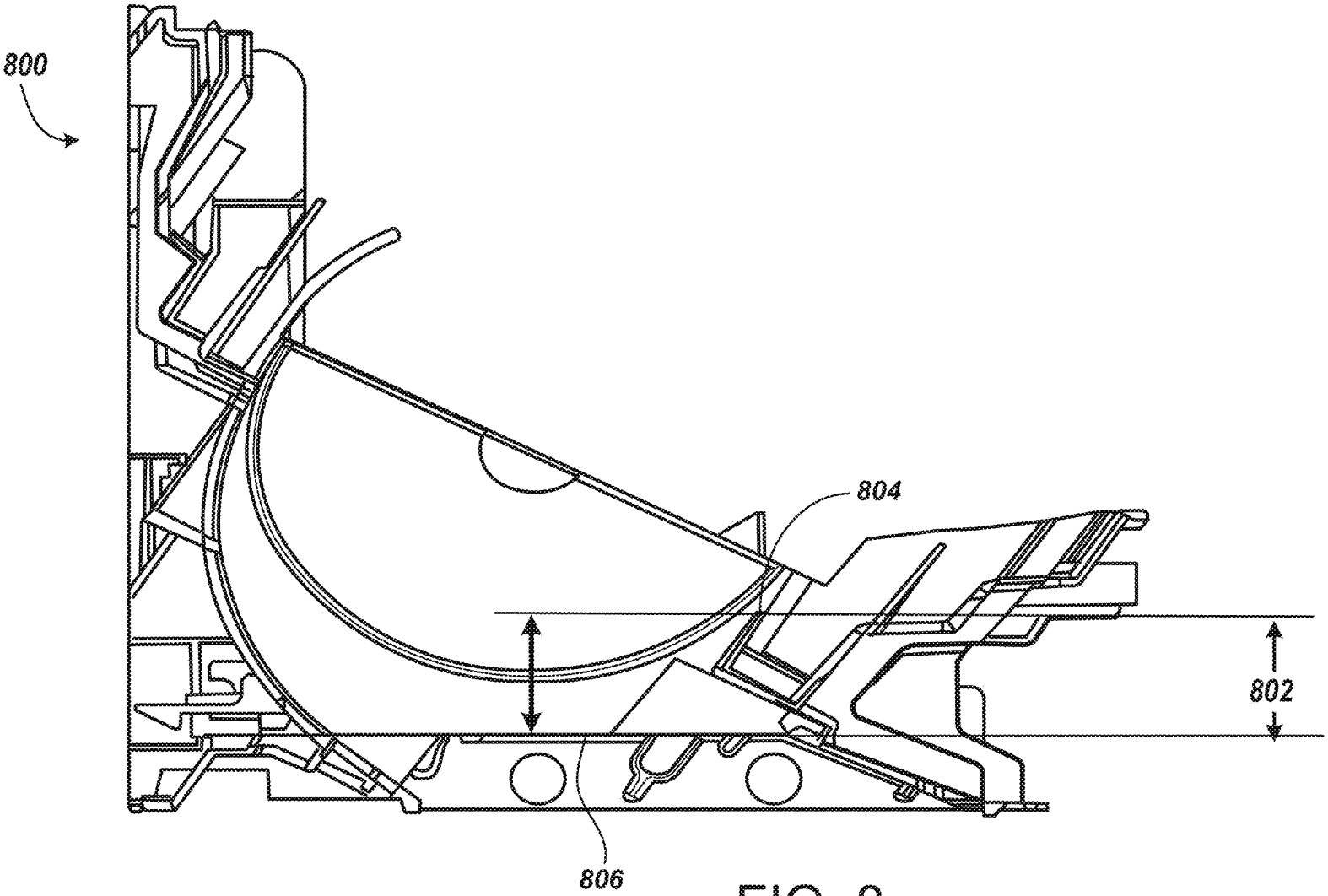
FIG. 8 illustrates a side view of an exemplary indoor unit showing a reduced height of a drainage channel for condensation.

FIG. 8 illustrates a side view of a portion of an exemplary indoor unit 800 showing a reduced height of a drainage channel for condensation runoff. The height of the typical condensation drainage channel may be 40 mm or more. Drainage channel height is defined as the head height of the channel, which is the gravity-vertical distance from the bottom of the drain outlet to the lowest point on the lip of the drain basin inside the unit. The embodiment shown in FIG. 8 can have a reduced height 802, e.g., the gravity-vertical distance from point 804 to point 806, of less than 40 mm or less than 30 mm or less than 25 mm.

Figure 9A:
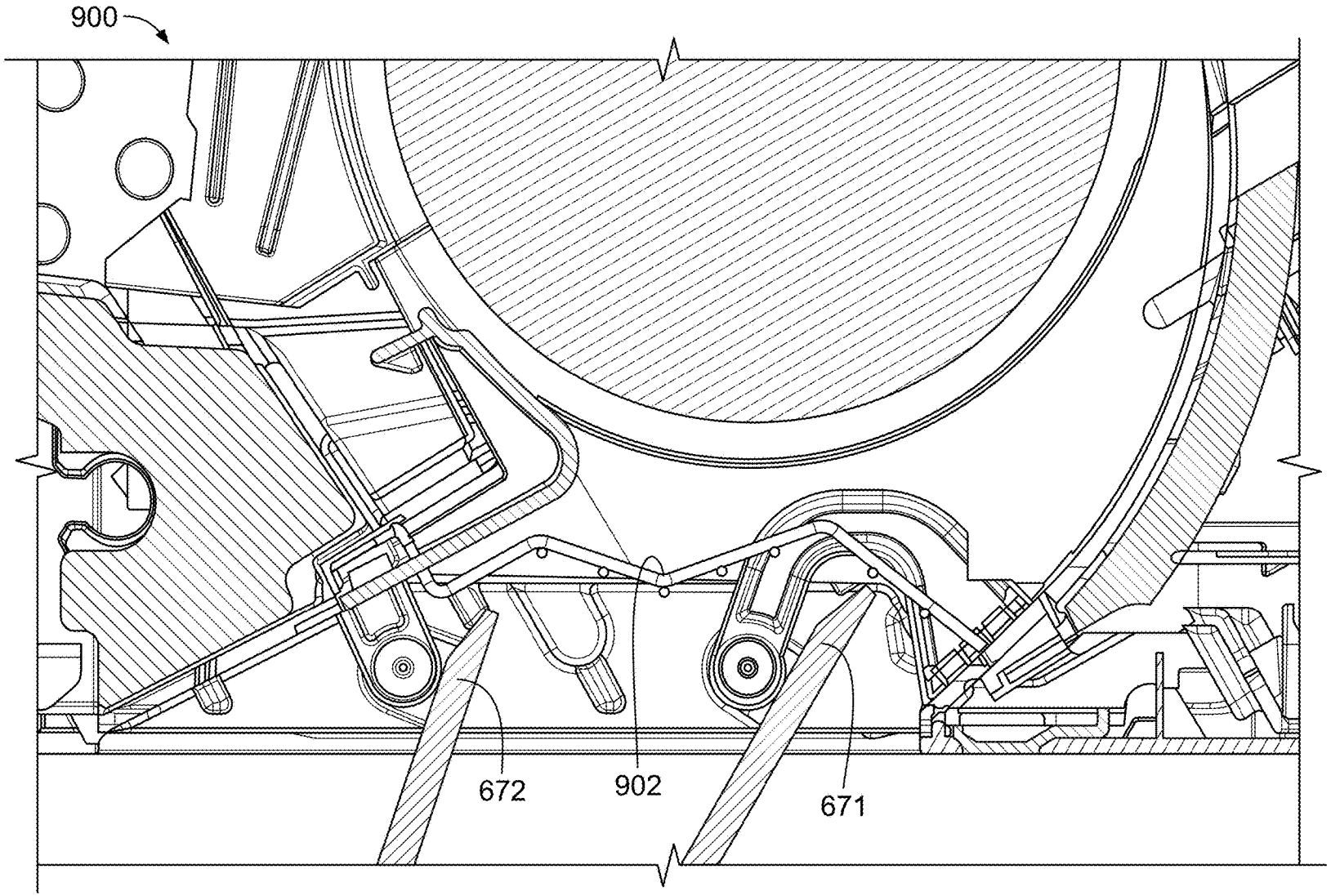
FIG. 9A illustrates a side view of a portion of an exemplary indoor unit showing a cross section of a fingerguard and the ends of two louvers closest to the indoor unit fan.

FIG. 9A illustrates a side view of a portion of an exemplary indoor unit showing a cross section of a fingerguard and the ends of two louvers closest to the indoor unit fan. The cross section of the fingerguard 902 is substantially the shape of an upside-down letter W. This shape allows the placement of the fingerguard 902 substantially as far from the fan 120 as possible while not interfering with the function of the louvers 671 and 672. Placing at least portions of the fingerguard further from the fan than would otherwise be possible, advantageously reduces noise and air turbulence.

Figure 9B:
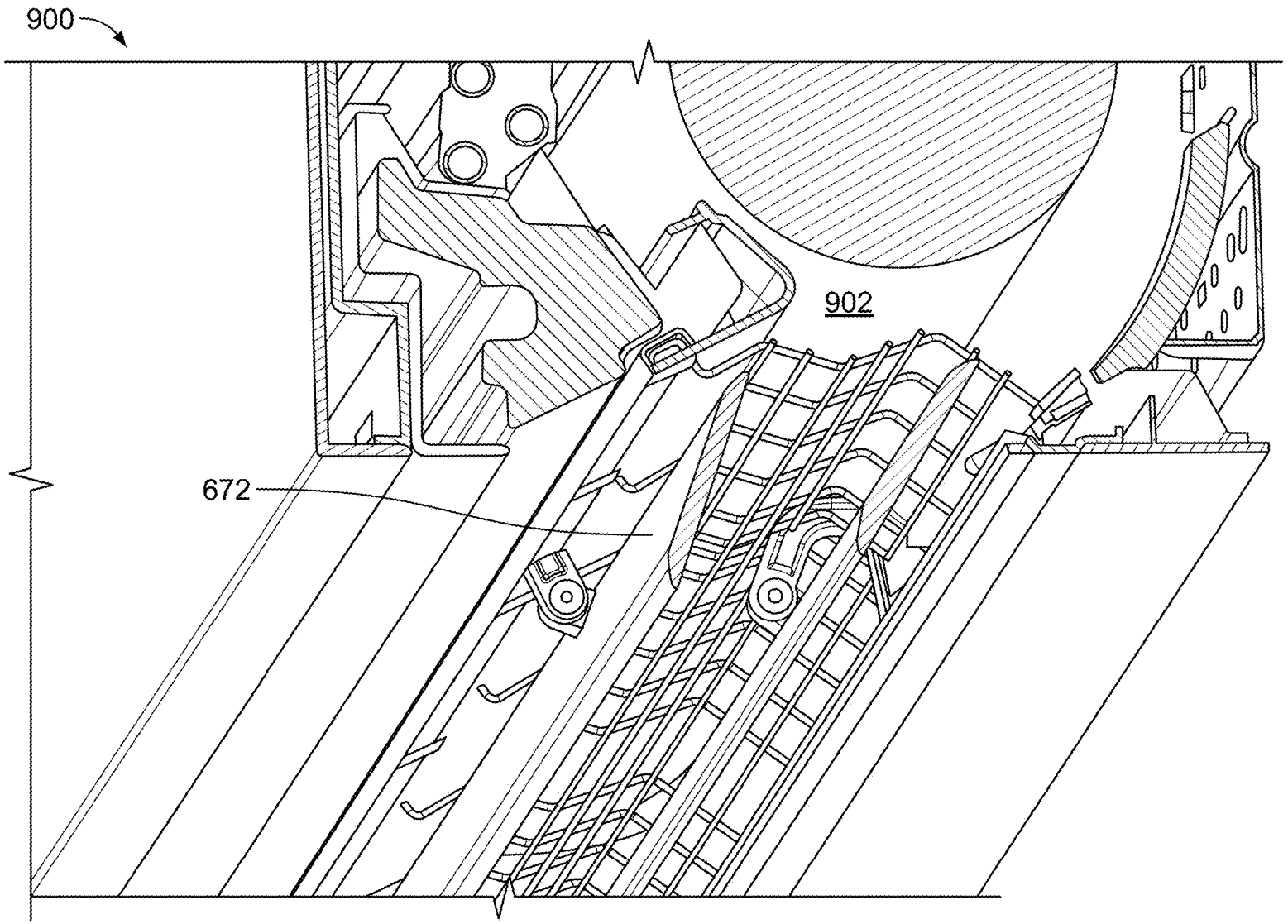
FIG. 9B illustrates a perspective view of an exemplary indoor unit showing a fingerguard and the ends of two louvers closest to the indoor unit fan.

FIG. 9B illustrates a perspective view of an exemplary indoor unit showing a fingerguard and the two louvers operating below the fingerguard. In the perspective view, one can see the grid configuration of the fingerguard and the bent upside down letter W cross-sectional shape of the fingerguard.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. An indoor unit comprising:

a housing comprising a plurality of panels joined together, the plurality of panels comprising:

a wall-side panel having an exit-point thereon;

a room-side panel arranged substantially parallel to the wall-side panel;

a lower panel arranged substantially parallel to the upper panel and substantially perpendicular to each of the wall-side and room-side panels;

a first side panel arranged substantially perpendicular to each of the wall-side, room-side, upper, and lower panels; and a second side panel arranged substantially parallel to the first side panel and substantially perpendicular to each of the wall-side, room-side, upper, and lower panels, wherein the housing has:

a height of less than 11 inches measured between the upper and lower panels;

a depth measured between the wall-side and room-side panels; and a width measured between the first and second side panels;

a refrigerant line running through the exit-port on the wall-side panel, the refrigerant line having a portion that is internal to the housing; and a plurality of components enclosed within the housing, the plurality of components comprising:

a heat-exchanger connected to the portion of the refrigerant line, wherein the portion of the refrigerant line is external to the heat exchanger, runs substantially within a height-depth plane perpendicular to the width of the housing, and traverses less than 25% of the width of the housing;

a fan arranged between the heat exchanger and the lower panel; and a control unit operatively coupled to the heat exchanger and the fan, wherein the indoor unit is configured to exchange at least 8000 BTUs/hour with a room and wherein the indoor unit produces a noise of 48 dBA or less.

2. The indoor unit of claim 1, wherein the room-side panel is removable from the housing.

3. The indoor unit of claim 1, wherein the fan is a cross flow fan.

4. The indoor unit of claim 1, further comprising a light bar attached to the lower panel.

5. The indoor unit of claim 1, wherein the housing has a single exit-point on the wall-side panel of the housing.

6. The indoor unit of claim 1, wherein the heat exchanger is an evaporator, condenser, or both an evaporator and condenser.

7. The indoor unit of claim 1, wherein a distance between a top of an upper most refrigerant line located within the heat exchanger and the top of the heat exchanger is less than 3.5 mm.

8. The indoor unit of claim 1, wherein the housing has a height of less than 8 inches.

9. The indoor unit of claim 1, wherein the housing has a width of less than 40 inches and a depth of less than 10 inches.

10. The indoor unit of claim 1, wherein the portion of the refrigerant line traverses a path having a plurality of U-shaped turns in the height-depth plane.

11. The indoor unit of claim 1, further comprising a fan outlet on the lower panel of the housing, at least one louver configured to guide air exiting the fan outlet, and a finger guard covering at least a substantial portion of the fan outlet and arranged between the fan and the louver.

12. The indoor unit of claim 11, wherein a cross section of the finger guard viewed from a side of the indoor unit is substantially in a shape of an upside-down letter W.

13. The indoor unit of claim 1, further comprising at least one louver attached to the lower panel of the housing, wherein a distance between a bottom most point of the fan and the lower panel of the housing when any louvers are closed is less than 80 mm.

14. The indoor unit of claim 13, wherein the distance between the bottom most point of the fan and the lower panel of the housing is less than 45 mm.

15. The indoor unit of claim 1, wherein the heat exchanger comprises:

a wall-side region between the fan and the wall-side panel;

a room-side region between the fan and the room-side panel; and one or more spacers between the wall-side region and the room-side region, wherein an angle between the wall-side region and a vertical axis and an angle between the room-side region and the vertical axis are each greater than or equal to twenty-five degrees and less than or equal to forty-five degrees, and wherein the vertical axis is substantially perpendicular to the upper and lower panels.

16. The indoor unit of claim 15, wherein the heat exchanger has a height of less than 130 mm measured along the vertical axis.

17. The indoor unit of claim 15, wherein the plurality of components further comprises a condensation catch arranged between the room-side region of the heat exchanger and the lower panel, and wherein the control unit is arranged within a dead space defined between the condensation catch, the lower panel, and the room-side panel.

18. The indoor unit of claim 15, wherein the one or more spacers comprises one or more holes, openings, or channels.

19. The indoor unit of claim 18, wherein the heat exchanger comprises a heat exchanger refrigerant line portion that runs through the one or more holes, openings, or channels.

* * * * *